US006366633B1

(12) United States Patent
Stezaly et al.

(10) Patent No.: US 6,366,633 B1
(45) Date of Patent: Apr. 2, 2002

(54) STORAGE AND DISPATCH CONTAINER FOR RADIOACTIVE MINIATURE RADIATION SOURCES

(75) Inventors: Kerstin Stezaly; Eberhard Fritz, both of Berlin (DE)

(73) Assignee: Eurotope Entwicklungsgesellschaft für Isotopentechnologien mbh (DE)

( * ) Notice: Subject to any disclaimer, the term of this patent is extended or adjusted under 35 U.S.C. 154(b) by 0 days.

(21) Appl. No.: 09/366,494

(22) Filed: Aug. 3, 1999

(30) Foreign Application Priority Data

Aug. 3, 1998 (DE) ..... 198 36 181
Aug. 3, 1998 (DE) ..... 198 36 188

(51) Int. Cl.[7] ..... G21F 5/15; G21F 5/18; G21F 5/06

(52) U.S. Cl. ..... 376/202; 250/505.1; 250/506.1; 250/428; 250/432; 250/435; 600/1; 600/7

(58) Field of Search ..... 376/272, 202; 250/505.1, 506.1, 515.1, 522.1, 428, 432, 435; 600/1–7

(56) References Cited

U.S. PATENT DOCUMENTS

| | | | | |
|---|---|---|---|---|
| 3,156,532 | A | * 11/1964 | Doering et al. | 23/252 |
| 3,446,965 | A | * 5/1969 | Ogier et al. | 250/106 |
| 3,564,256 | A | * 2/1971 | Arlman et al. | 250/106 |
| 3,957,033 | A | * 5/1976 | Winchell et al. | 128/1.1 |
| 4,188,539 | A | * 2/1980 | Strecker | 250/432 |
| 4,634,873 | A | * 1/1987 | Bezer et al. | 250/497.1 |
| 5,514,071 | A | * 5/1996 | Sielaff, Jr. et al. | 600/3 |
| 5,519,931 | A | * 5/1996 | Reich | 29/426.3 |
| 5,899,822 | A | * 5/1999 | Waksman et al. | 604/96 |
| 6,090,035 | A | * 7/2000 | Campbell et al. | 600/7 |
| 6,117,064 | A | * 9/2000 | Apple et al. | 600/3 |
| 6,159,144 | A | * 12/2000 | Angel et al. | 600/5 |

FOREIGN PATENT DOCUMENTS

| | | | |
|---|---|---|---|
| CN | 1064022 | * | 9/1992 |
| DE | 3640790 | * | 6/1998 |
| DE | 19731118 | * | 1/1999 |
| EP | 586368 | * | 3/1994 |
| JP | 63-285952 | * | 11/1988 |
| JP | 08-338874 | * | 12/1996 |
| ZA | 821625 | | 12/1982 |
| ZA | 8201625 | * | 12/1982 |
| ZA | 8304434 | * | 1/1984 |

* cited by examiner

*Primary Examiner*—Michael J. Carone
*Assistant Examiner*—Jack Keith
(74) *Attorney, Agent, or Firm*—Norris, McLaughlin & Marcus P.A.

(57) ABSTRACT

The invention describes a storage and dispatch container for variable quantities of radioactive miniature radiation sources as well as a locking and opening device for the said storage and dispatch container and is applicable for the transport of radioactive miniature radiation sources in well organized and undamaged condition.

The dispatch containers serve as storage depots at the same time and meet the requirements of radiation safety with passive protection from loss. Their construction permits automatic filling or transfer of the contents using a corresponding device.

The container is characterized in that a capillary tube (8) for the uptake of the radiation sources (15) is arranged in the main body (1) of the container and that the main body (1) exhibits a lower end-piece (2) with a fluid-medium connection (4) as well as an upper end-piece (3) with an input/output opening **(3*a*) for the radiation sources (15), which can be locked by means of a locking mechanism (10)**.

The locking and opening device for storage and dispatch containers for radioactive miniature radiation sources is characterized in that a slide valve (18), positioned between headpiece (16) and a cover (22), exhibits a cut-off needle (26) which opens or locks the input/output channel (23) in the neck (17) when the slide valve (18) is actuated.

16 Claims, 4 Drawing Sheets

STORAGE AND DISPATCH CONTAINER FOR RADIOACTIVE MINIATURE RADIATION SOURCES

BACKGROUND OF THE INVENTION

The invention relates to a storage and dispatch container for variable quantities of radioactive miniature radiation sources as well as a locking and opening device for the said storage and dispatch container and is applicable for the transport of radioactive miniature radiation sources in well organized and undamaged condition. The dispatch containers serve as storage depots at the same time and meet the requirements of radiation safety with passive protection from loss. Their construction permits automatic filling or transfer of the contents using a corresponding device.

The construction of the locking and opening device makes it possible to open a correspondingly designed container, i.e. allowing free access to its input/output channel, and thus manually or automatically fill the radioactive miniature radiation sources into a container or remove them from the same without direct contact.

The miniaturization of radioactive radiation sources first took place in recent times and the wish to be able to remove these sources from a container in a certain order (axially oriented) demanded a suitable storage and transport concept. No comparable storage and transport container has existed until now.

Automation of the production of radioactive radiation sources also first took place in recent times and required a new concept with reference to the filling of the final packaging.

A transfer device incorporated in a system for the radioactive irradiation of blood vessels, wherein the radioactive radiation sources are fed into a catheter is described by WO 97/37715 A1. This device serves the sole purpose of introducing the radioactive sources into the catheter during treatment (of human beings) and then conveying them back into the device. This device provides screening for the clinical staff at the same time. It is not conceived as a storage and dispatch container.

SUMMARY OF THE INVENTION

The invention is based on the objective of creating a packaging which makes safe storage as well as safe transport of axially oriented radioactive miniature radiation sources possible, wherein the filling up and emptying with simple means is reliable and practicable, and wherein the packaging can be manufactured simply and inexpensively.

A further objective of the invention is the creation of a locking and opening device by means of which safe loading and unloading of axially oriented radioactive miniature radiation sources in containers is made possible.

According to the invention, this objective is achieved by the features in the characterization parts of claims 1 and 10 acting in conjunction with the features of the classifying clause. Purposeful embodiments of the invention are to be found in the subordinate claims.

A particular advantage of the invention consists in that safe transport as well as the safe storage and non-hazardous handling of miniature radiation sources made possible in that a capillary tube for the uptake of the radiation sources is arranged in the main body of the container and that the main body exhibits a lower end-piece with a fluid-medium connection as well as an upper end-piece with an input/output opening for the radiation sources, which can be locked by means of a locking mechanism.

Further advantages of the invention are the manual as well as the automatic remote control filling capacity of the container, the variability of the number of miniature radiation sources to be loaded, the orderly removal of the sources and the sure determination of the level of contents.

The container meets the radiation safety requirements by means of the materials used, and medium-term storage of the sources in the said container is possible.

The transparency of the materials used ensures that both the level of contents and the condition of the radiation sources can be optically controlled and that the radiation sources can be counted.

The design of the dispatch and storage container makes variations possible in the number of radiation sources to be dispatched. The input/output channel lock cannot be opened without auxiliary devices, whereby unintentional unloading is prevented.

An additional advantage of the invention is that non-hazardous and gentle handling of miniature radiation sources during conveyance into and out of a container is possible by means of a slide valve positioned between headpiece and cover which opens or locks the input/output channel in the neck with a cut-off needle when the slide valve is actuated.

Further advantages of the invention are the rapid automatic and thus safe remote input and removal of radioactive miniature radiation sources from geometrically suitably designed filling packages (containers), a high degree of safety within the meaning of radiation safety and the possibility of the orderly input of several radiation sources in one operation.

BRIEF DESCRIPTION OF THE DRAWINGS

The invention is explained hereinafter in more detail in the light of exemplary embodiments illustrated at least partially in the figures.

Shown in

DESCRIPTION OF THE PREFERRED EMBODIMENTS

Figure 1:
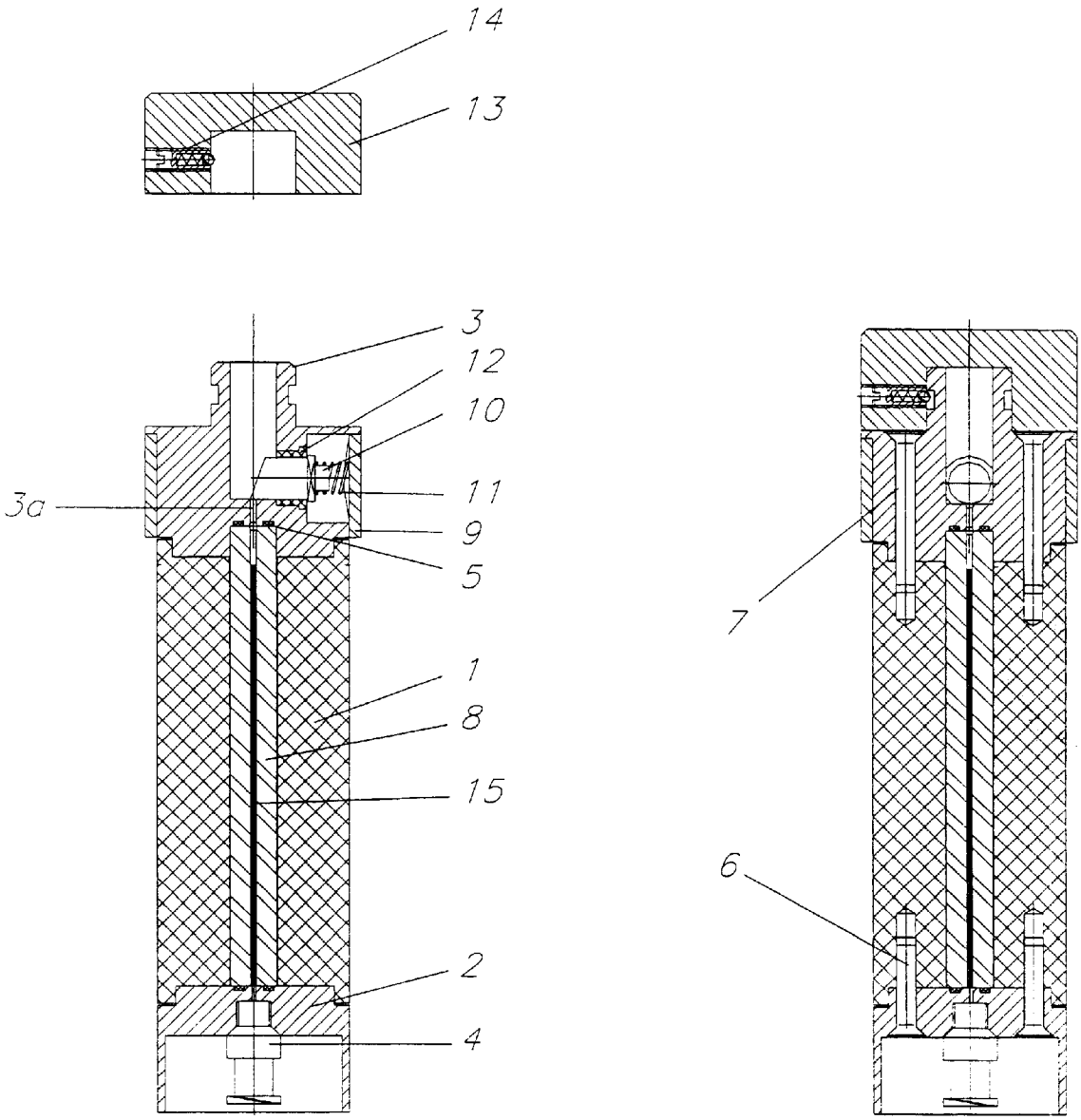
FIG. 1 are illustration of the front and side views of the storage and dispatch container.

As can be seen in FIG. 1, the storage and dispatch container consists of a main body 1 with a capillary tube 8 for the uptake of the radiation sources 15. The radiation sources 15 (cylindrical tube sections) are arranged end-to-end in a quartz glass capillary tube 8 which is enveloped by the main body of the container for reasons of radiation safety and visibility. This part is fully symmetrical apart from an appropriate mark in the form of a groove on the internal diameter of the acrylic glass main body 1 to show the level of contents.

Storage and transport of the radiation sources 15 fundamentally takes place with the main axis in a vertical position.

The lower end (standing surface) of this tube-in-tube combination is closed by a cylindrical lower end-piece 2 made of aluminum. The internal tubular section of the glass capillary tube 8 continues eccentrically with a smaller diameter inside this lower end-piece 2 and finishes in a commercially available fluid-medium connection 4 (quick coupling) by means of which catheters, syringes or similar items may be connected. Suitable transport media, air for example, can be introduced via this medium connection 4 in order to expel the radiation sources 15 out of the container. The lower end-piece 2 is attached to the main body 1 with two screws 6.

The opposite end of the tube-in-tube combination is also closed by a cylindrical upper end-piece 3 made of aluminum. The internal diameter of the glass capillary tube 8 continues concentrically inside it. The said tubular section serves the input and output of the radiation sources 15. This tube is closed by a plunger 10 which is self-actuated by the force of the compression spring 11 and can only be opened using a corresponding counterpart, here the adapter 16. The opening is achieved by a wedge effect. The plunger 10 has the lateral effect of a slide valve and is guided by a bush. A clamping ring 9 secures the spring 11 and the plunger 10 against loss. This end-piece is also attached to the main body 1 with two screws 7.

Another possibility of connecting the upper and lower end-pieces 3, 2 to the main body 1 consists of direct screwing/gluing to the main body 1. The screws 6 and 7 then become redundant. The two sealing rings 5 hold the quartz glass capillary tube 8 firmly between the upper and lower end-pieces 3 and 2 respectively.

A cylindrical closure cap 13 protects the accurately drilled channel in the upper end-piece 3 from contamination. The said cap is pressed against the upper end-piece 3 using a ball catch 14.

Figure 2:
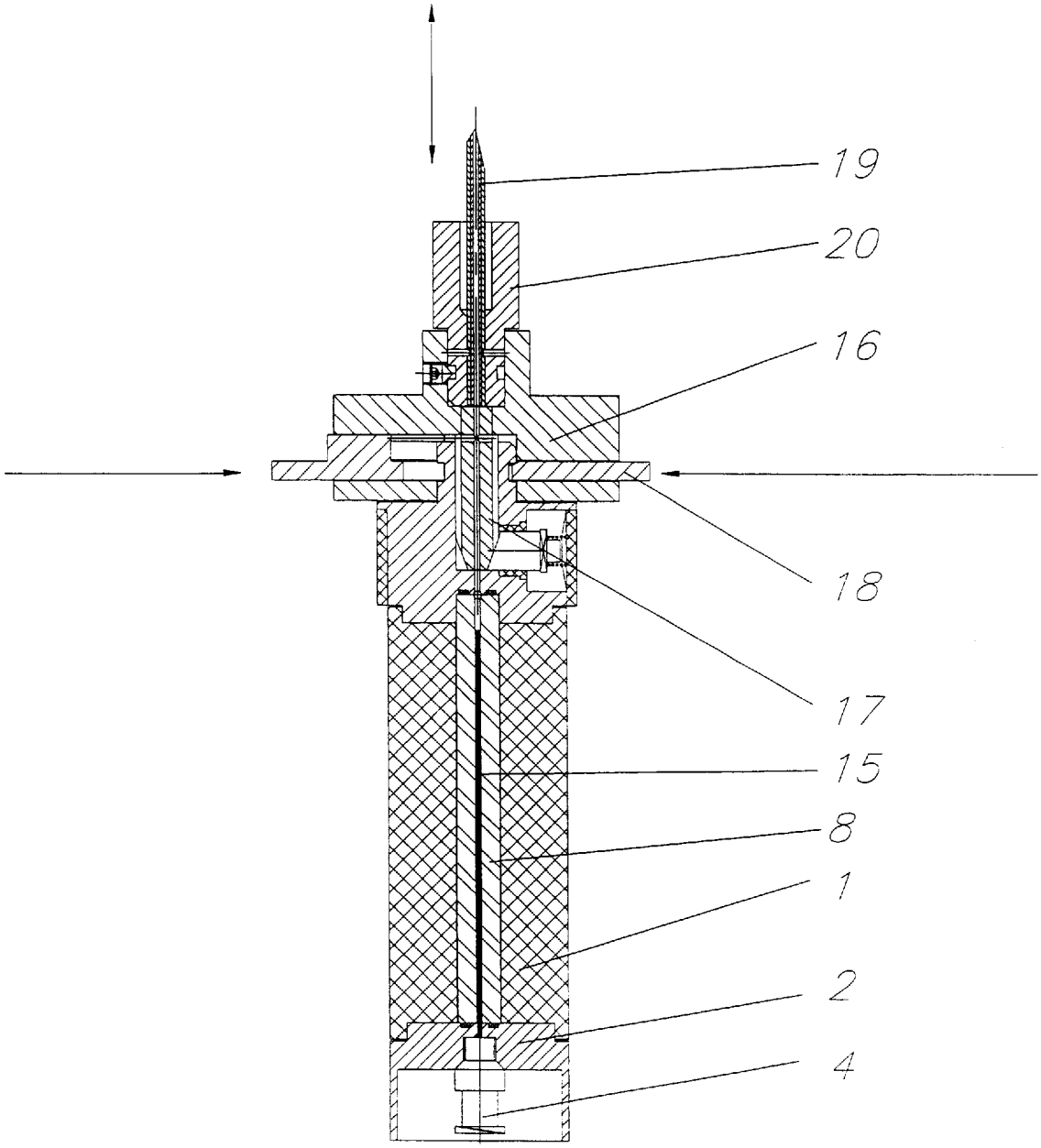
FIG. 2 is an illustration of the storage and dispatch container with an adapter fitted onto it.

The following is a description of the input/output of the radiation sources 15 in the storage and dispatch container using an adapter as shown in FIG. 2.

The storage and dispatch container with its accurately broached channel is pushed onto the neck 17 of the adapter (against the resistance of the seal) after removal of the closure cap 13. The plunger 10 is moved during this process, thus allowing free access to the input channel. A precondition for this is that the slide valve 18 is set at "open" (prior to connection).

Figure 3:
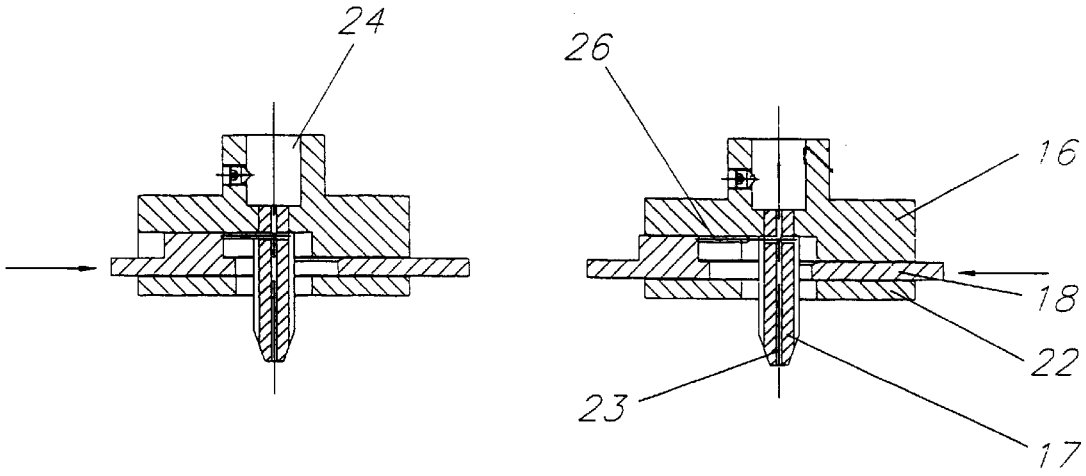
FIG. 3 is an illustration of the locking and opening device for storage and dispatch containers for radioactive miniature radiation sources in open and closed position.

Held like this by an expedient device, the slide valve 18 can be moved to the closed position (safe) by hand or other contrivance. The chamfered edge of the oblong hole in the slide valve 18 is pressed against the edge of the upper end-piece 3 in this case, as shown in FIG. 3, thus holding the container pressed against the neck 17. The input channel is opened in true alignment in this way.

Radiation sources can be conveyed into the storage and dispatch container by installing a catheter 19 on the headpiece 16 of an adapter using a catheter-adapter 20 and by using a transport medium, air for example. The container can be unloaded under the precondition that a suitable transport medium is attached to the medium connection 4 of the storage and dispatch container and that a corresponding collection container is located at the end of the catheter 19.

The container can be dismantled to its component parts and cleaned so that it can be used again after exchanging the "radiation damaged" parts.

The container can be utilized for beta-emitting radiation sources. The said container can also be used for storage and dispatch of gamma-emitters of different photon energy if lead acrylic glass, for example, is used as the material of the main body 1, or for changing the wall thickness of the main body 1 and/or the capillary tube 8.

As can be seen in FIG. 3, The locking and opening device consists of a cylindrical headpiece 16 and the cover 22 which is designed as a round metal washer. The headpiece 16 and cover 22 are joined together with screws 21. A slide valve 18 embedded in the headpiece 16 runs between headpiece 16 and cover 22. The slide valve 18 projects from opposite sides of the headpiece 16/cover 22 so that it can be pushed back and forth by the wings 18*a* and 18*b*. The slide valve 18 possesses a cylindrical pin acting as the cut-off needle 26 which projects into the side of the input/output channel 23 of the neck 17 in the opened condition of the said device thus blocking the input/output channel 23. All three designated parts, the headpiece 16, slide valve 18 and cover 22, possess a centralized opening designed as a drill hole which accommodates the opening of the correspondingly designed container.

The slide valve is designed in such a way that the said drill hole is oblong and tapers somewhat. This taper is chamfered in the direction of the headpiece 16.

The locking and opening device is intended for operation with the axis in the vertical direction.

The neck 17 with the input/output channel 23 for radiation sources is anchored in the headpiece 16. The neck 17 is an cylindrical alignment insert which can be introduced into a correspondingly aligned socket of the container thus providing a truly aligned connection to the input/output channel 23 of the container. In addition to the input/output channel 23 in the center, the neck 17 also possesses four flutes in the main axis direction in order to counteract the suction effect of coupling and uncoupling as well as a transverse drilling in the upper part to accommodate the cut-off needle 26.

The headpiece also possesses the insertion opening 24 for catheter adapter 20 of the catheter tube through which the radioactive radiation sources are fed in or out.

The said catheter adapter 20 is secured with a set screw.

The loading and unloading process is described in the following.

Figure 4:
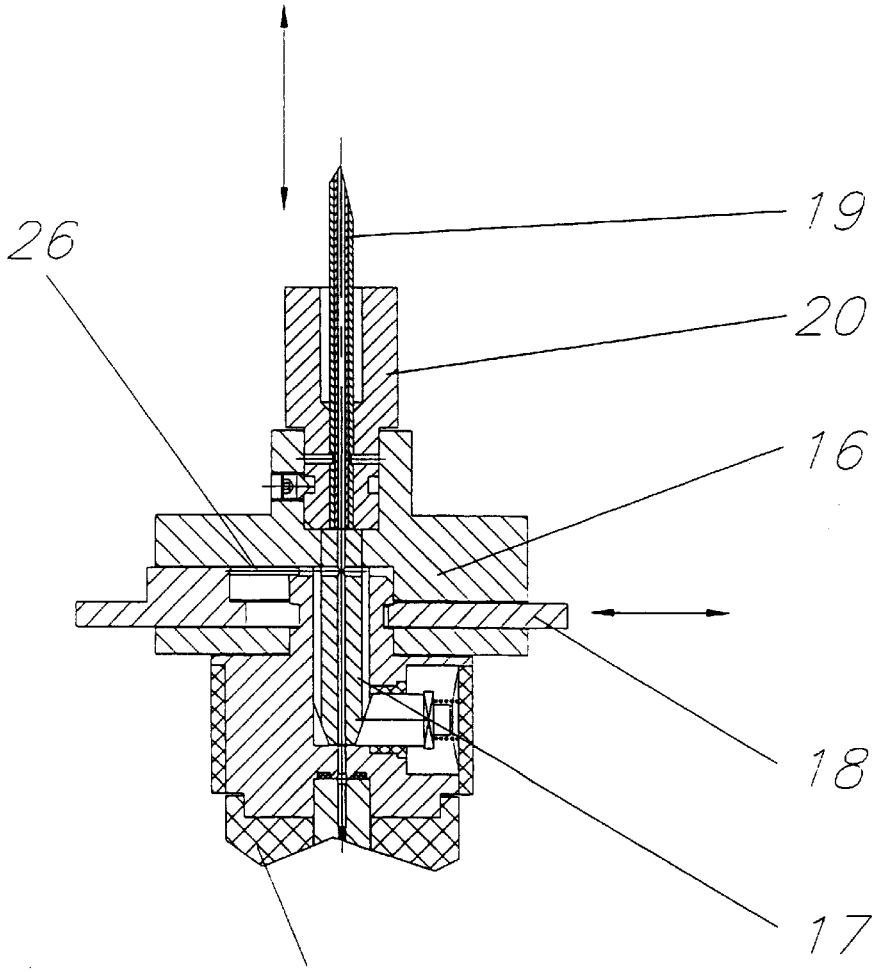
FIG. 4 is an illustration of the locking and opening device for the storage and dispatch container for radioactive miniature radiation sources with catheter adapter and the indicated storage and dispatch container, FIG. 5 are detailed views of the slide valve in open and closed position.
Figure 5:
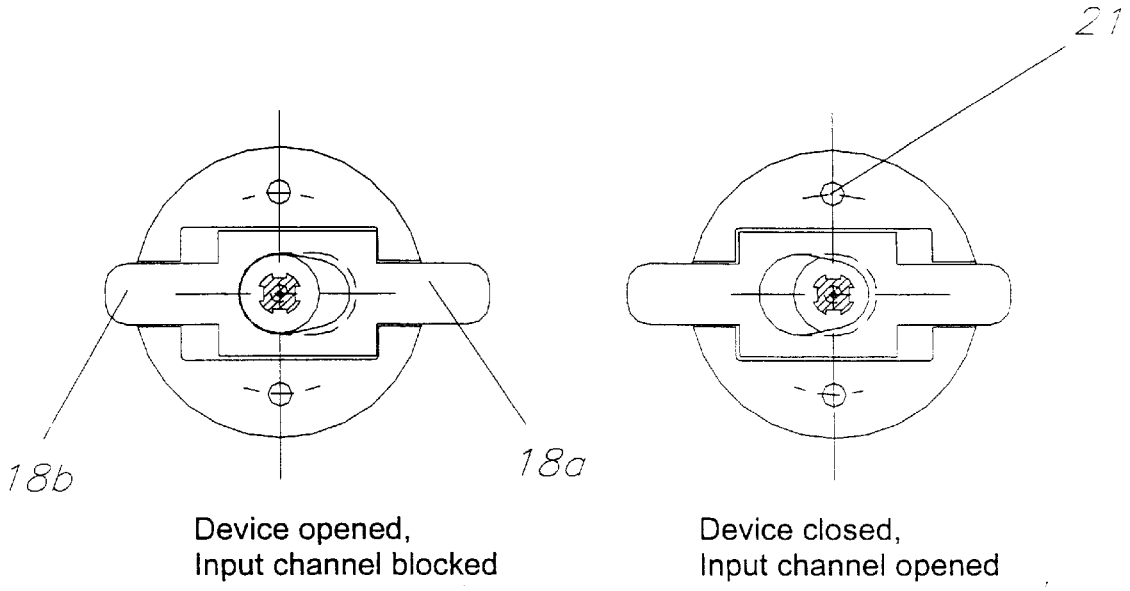

The container has to be pushed onto the neck 17 in order to fix the container in the locking and opening device as shown in FIG. 4. A lock on the container is self-actuated and moved during this process, thus allowing free access to the input/output channel 23. A precondition for this is that the slide valve 18 is set in the position "station open" as shown in FIG. 5. The slide valve 18 can now be moved to the position "station closed". The cut-off needle 26 is pulled back at the same time in this process and allows free access to the input/output channel 23 in neck 17. The previously described chamfered edge of the oblong hole in the slide valve 18 now presses against an edge of the container, thus keeping the latter pressed under tension against the neck 17.

The input/output channel 23 is opened with true alignment.

Provided a suitable transport medium is connected and the catheter 13 is attached by its catheter adapter 20 to the headpiece 16, the radioactive radiation sources can now be conveyed into or out of the said container.

The invention is not confined to the exemplary embodiments shown here. On the contrary, it is possible to achieve other variants of the embodiments by combination and modification of the designated means and features without departing from the framework of the invention.

What is claimed is:

1. Storage and dispatch container for radioactive miniature radiation sources arranged successively in a main body, comprising a main body with a capillary tube (8) arranged therein to accommodate the sources of radiation (15), the main body having a lower end-piece (2) with a fluid-medium connection (4) and an upper end-piece (3) with an input/output opening **(3*a*) for the radiation sources which is lockable by a self-actuated locking mechanism (10); and a locking and opening device for loading and unloading the radiation sources from the container, wherein the self-actuated locking mechanism (10)** is a plunger which is structured to interact with an adapter to allow free access to the upper opening of the capillary tube.

2. The container according to claim 1 wherein the capillary tube (8) consists of quartz glass and the main body (1) of acrylic glass.

3. The container according to claim 1 wherein the lower end-piece (2) and the upper end-piece (3) consist of aluminum.

4. The container according to claim 1 wherein the radiation sources (15) in the capillary tube (8) are successively arranged end-to-end.

5. The container according to claim 1 wherein the cross-sections of the capillary tube (8) and the main body (1) are circular.

6. The container according to claim 1 wherein the internal diameter of the capillary tube (8) is continued in the lower end-piece (2) with a smaller diameter eccentric to the medium connection (4) and in the upper end-piece (3) with the same diameter to the input/output opening **(3*a*)**.

7. The container according to claim 1 wherein the upper end-piece (3) can be sealed with a closure cap (13).

8. The container according to claim 1 wherein the main body (1) has level markings.

9. The container of claim 1, wherein the Locking and opening device comprises a slide valve (18) arranged between a headpiece (16) and a cover (22), and a cut-off needle (26) which alternatively opens or blocks an input/output channel (23) in a neck (17) upon actuation of the slide valve (18).

10. The container according to claim 9 wherein the slide valve (18) has wings **(18*a*, 18*b*) projecting from opposite sides of the headpiece (16) and cover (22) and which serve to actuate the slide valve (18)**.

11. The container according to claim 9 wherein the cut-off needle (26) is a cylindrical pin.

12. The container according to claim 9 wherein the headpiece (16), the cover (22) and the slide valve (18) possess a centralized opening into which the opening of a correspondingly designed container fits.

13. The container according to claim 12 wherein the opening in the slide valve (18) is oblong and of tapered form.

14. The container according to claim 13 wherein the taper is chamfered in the direction of the headpiece (16).

15. The container according to claim 9 wherein

The neck (17) exhibits flutes in the main axis direction as well as a transverse drilling to accommodate the cut-off needle (26).

16. The container according to claim 9 wherein

The headpiece (16) has an insertion opening (24) for a catheter adapter (20).

* * * * *